US005411422A

United States Patent [19]

Robertson

[11] Patent Number: 5,411,422

[45] Date of Patent: May 2, 1995

[54] SPIRAL PROPELLER HAVING AXIAL VOID

[76] Inventor: David H. Robertson, R 18 Hayden Rd., Blandford, Mass. 01008

[21] Appl. No.: 275,813

[22] Filed: Jul. 15, 1994

Related U.S. Application Data

[63] Continuation of Ser. No. 93,555, Jul. 19, 1993, abandoned.

[51] Int. Cl.[6] ..... B63H 1/26

[52] U.S. Cl. ..... 440/48; 416/176

[58] Field of Search ..... D12/214; 416/176, 177; 440/48, 49

[56] References Cited

U.S. PATENT DOCUMENTS

| | | | |
|---|---|---|---|
| 1,459 | 0/1839 | Beecher . | |
| 30,360 | 0/1860 | Stanley . | |
| D. 203,719 | 2/1966 | Martens | D71/1 |
| D. 203,721 | 2/1966 | Martens | D71/1 |
| 812,604 | 2/1906 | Sitzler . | |
| 835,313 | 11/1906 | O'Flynn | 416/176 |
| 941,923 | 11/1909 | Hoffman . | |
| 1,358,430 | 11/1920 | Faehrmann | 416/176 |
| 1,371,610 | 3/1921 | Dungan | 416/176 |
| 1,595,949 | 8/1926 | Kirin . | |
| 1,748,697 | 2/1930 | Maier-Bearing . | |
| 1,892,182 | 12/1932 | Thayer | 416/176 |
| 1,961,415 | 6/1934 | Koning et al. | 416/176 |
| 2,388,711 | 11/1945 | Sawyer | 115/19 |
| 3,070,061 | 12/1962 | Rightmyer | 115/34 |
| 3,233,574 | 2/1966 | Justinien | 115/19 |
| 3,426,721 | 2/1969 | Justinien | 115/19 |

FOREIGN PATENT DOCUMENTS

| | | | |
|---|---|---|---|
| 758374 | 6/1933 | France | 2/6 |
| 954423 | 1/1949 | France | 2/6 |
| 93909 | 9/1897 | Switzerland | 416/176 R |
| 16558 | 3/1898 | Switzerland | 416/176 |
| 172560 | 11/1932 | Switzerland | 440/49 |

*Primary Examiner*—Edwin L. Swinehart
*Attorney, Agent, or Firm*—Fishman, Dionne & Cantor

[57] ABSTRACT

A propeller is presented which comprises a one piece blade that spirals out from an angular solid hub portion in smooth transition as a continuous screw spiral (or helix). Throughout its length, the spiral screw portion has an open center, (i.e., axial void) which when rotating is filled totally by water both inside the center void and in all spaces between the spiral blades. The spirals of the spiral screw portion are angled so that the pitch angle has a concave face or pushing surface which results in water trapped within the center and between the pitch faces being forced to pulse and thus be thrown back with great force from the end of the spiral screw.

5 Claims, 1 Drawing Sheet

SPIRAL PROPELLER HAVING AXIAL VOID

This is a continuationn of application Ser. No. 08/093,555 filed on Jul. 19, 1993, now abandoned.

BACKGROUND OF THE INVENTION

The present invention relates to a new and improved propulsion propeller to propel boats and the like. More particularly, this invention relates to a novel hollow centered spiral propeller which can be formed in one piece and which has pitched surfaces and an open outlet allowing fish and the like to escape without injury.

Propellers used in water for driving boats and the like are well known. Representative examples of such propellers are disclosed in U.S. Pat. Nos. 203,719 and 203,721 to LeRoy Martens. Both of these patents disclose propellers suitable for their intended purpose. However, these two propellers can injure fish and the like as the propeller slices through the water. Also, these prior art propellers tend to develop undesired turbulence as the water rushes around the whirling propeller. Other prior art propellers such as described in U.S. Pat. Nos. 3,426,721 to Justinien and 2,388,711 to Sawyer, rely heavily on a linking particular screw designs with specific boat designs, In addition, in general, the prior art propellers discussed previously lack efficiency and present a danger to sea life. Other patents of interest in this area, which pose similar problems, include U.S. Pat. Nos. 1,459; 30,360; 812,604; 941,923; 1,595,949; 3,070,061; and 3,233,574.

SUMMARY OF THE INVENTION

The above-discussed and other drawbacks and deficiencies of the prior art are overcome or alleviated by the propeller of the present invention. In accordance with the propeller of the present invention, a propeller is provided having a spiral configuration characterized by an axial space or void. Preferably, the propeller of this invention is one piece and is made from metal which is cast, machined, forged or otherwise formed to the desired finished shape and finish. In a preferred embodiment, the propeller spirals out from an angular solid hub portion which tapers to an open end of the spiral. The hub portion is solid but angularly offset from the vertical. The hub portion is also convexly faced such that its thinner portion is located at the point of rotational intake of the water. The hub portion is thus the heaviest at the point at which the hub body portion becomes part of the spiral screw. The spiral eminating from the hub portion continues in a smooth transition as a continuous screw spiral. Throughout its length, the spiral screw portion has an open center or void so that which water completely fills the center and all spaces between the spiral screw blade.

The spirals of the spiral screw portion are angled so that the pitch angle also has a concave face or pushing surface. The water thus trapped within the center and between the pitch faces of the spiral screw is forced to pulse (thus creating a pulsing action). This pulsing action is created by the hub portion because when the hub portion rotates from the "thin" or intake side, the hub portion in effect cuts the water as the water flows in between the pitch-faces. Thereafter, when the thicker portion of the hub rotates around, the water is pushed through the center and is trapped by the first portion of the screw (hub portion). When the screw is in constant rotation, the screw is taking in water between all pitched faces, and also through the center. Thus, as the water flows, it is cut and pulsed by the thicker hub portion. The water is thus whipped or thrown back with great force at the end of the spiral screw. In addition, the outside angle of the spiral screw body is slightly convex or rounded back, allowing the water to pass over smoothly with very little turbulence.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 3:
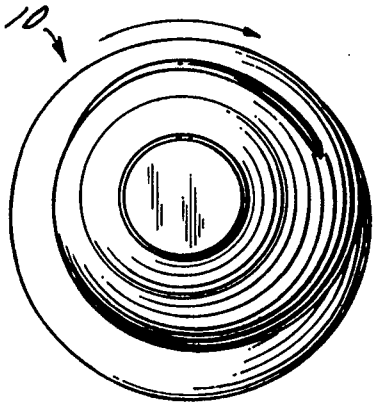
FIG. 3 is a right elevation view of the propeller of FIG. 1.
Figure 1:
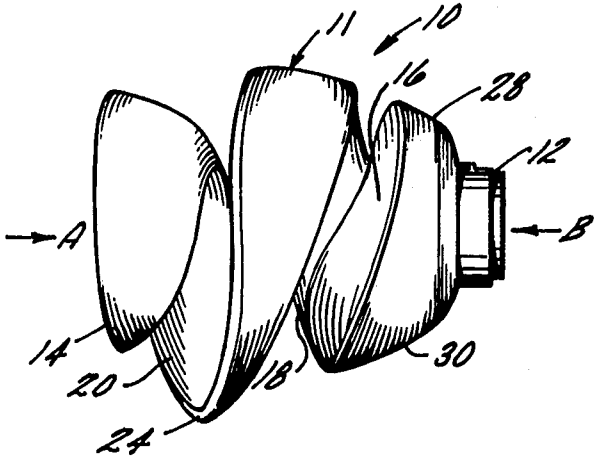
FIG. 1 is a side elevation view of the spiral configured propeller of the present invention.
Figure 2:
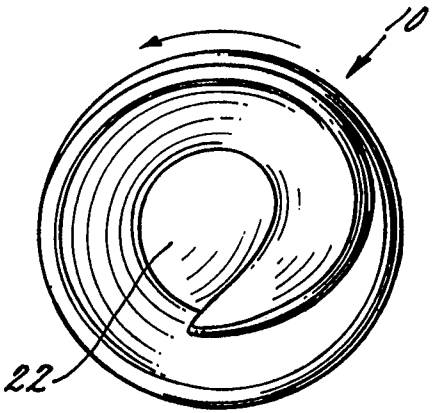
FIG. 2 is a left end elevation view of the propeller of FIG. 1.

In FIGS. 1–3, a preferred embodiment of the propeller of the present invention is generally shown at 10. Propeller 10 comprises a machined, forged, or otherwise formed spirally shaped cast body 11 eminating from one end 12 (which is referred to as the hub end) and spiraling out from the hub end 12 to a terminal end 14. Spiral blade or body 11 preferably has a helix configuration which defines an axial void through its center 22. Each wind or spiral in body 11 preferably is gradually larger in circumference (from a hub 16 outwards) than the previous face or turn so as to constitute a gradually taperd spiral. Hub portion 16 is convexly faced, such that, as the propeller rotates, surface portion 16 pushes against the surrounding water. The spiral body 11 continues out from hub 16 in a smooth transition as a continuous open centered screw such that the spiral body 11 defines a concave face or pushing surface. As a result, water trapped within the center void 22, and between the pitch faces of the spiral screw, is forced to pulse (thus creating a pulsing action). This pulsing action is created by the hub portion 12 and concave surface 16 as the hub portion 12 rotates from the "thin" or intake side 18. In other words, the hub portion 16 effectively cuts the water as the water flows in between the pitch-faces 20. When the thicker portion of the hub rotates the water is pushed through the center void 22 and is trapped by the first portion of the screw (hub portion 16). When the screw 10 is in constant rotation, the screw takes in water both between all pitched faces and also through the center void 22. Thus, the water flows and is cut and pulsed by the thicker hub portion 12. The water is therefore whipped or thrown back with great force exiting at the end of the spiral screw. In addition, the outside angle of the spiral screw body has slightly convex, or rounded back surfaces 24. This allows the water to pass over the surfaces of the screw smoothly so as to minimize turbulence.

Figure 4:
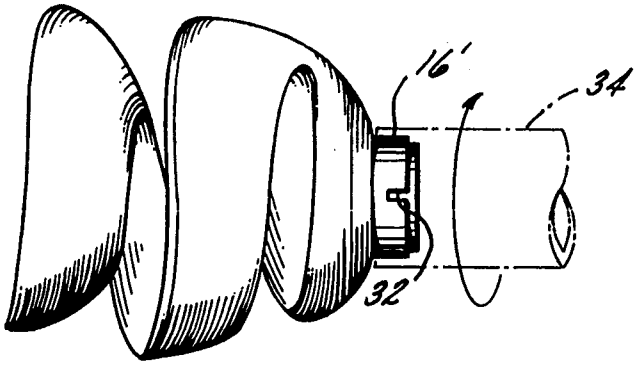
FIG. 4 is a side elevation view of an alternate embodiment of the propeller of this invention depicted with a keyed hub.

Hub portion 16 preferably is tapered as shown by the angle surfaces 28, 30 which converge towards hub end 12 for eliminating drag or water friction. In an alternative embodiment depicted in FIG. 4, hub 16' includes a key 32 for connection to a drive shaft shown in phantom at 34.

In accordance with an important feature of this invention, the propeller 10 can be cast, formed, forged or machined in any method known in the art. In addition screw body 11 may be made from non corrosive composite materials made of fiberglass or any other suitable plastic material can be used.

The present invention provides many features and advantages relative to the prior art. The unique design of the open center allows fish or other sealife to flow freely in and around the surfaces of the propeller without serious injury. Also, because of the low turbulence of this propeller configuration, a high propulsion to energy ratio is achieved.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A propeller comprising:

a) a hub;

b) a blade including a series of winds each wind having a convex outer region, said blade having a first end adjacent said hub and a second end at a point of termination of said blade remote from said hub, said blade extending helically from said hub in a radially expanding peripheral dimension to about a midpoint between said first and said second end of said blade whereabout said blade contracts in radial peripheral dimension until the blade terminates at said second end of said blade, said blade defining an axial void over a length thereof.

2. The propeller of claim 1 wherein:

said hub has a convex configuration.

3. The propeller of claim 1 wherein:

said hub is tapered and converges away from said spiral blade.

4. The propeller of claim 1 wherein:

said spiral blade is thicker at said hub and is thinner away from said hub.

5. A propeller as claimed in claim 1 wherein:

each wind of the blade defines a concave surface for pushing water passing against the blade.

* * * * *